US007334698B2

(12) United States Patent
Tobias

(10) Patent No.: US 7,334,698 B2
(45) Date of Patent: Feb. 26, 2008

(54) PROTECTIVE CONTAINER FOR AN AMPOULE

(76) Inventor: Renee Tobias, 400 Poplar Dr., Wheeling, IL (US) 60090

( * ) Notice: Subject to any disclaimer, the term of this patent is extended or adjusted under 35 U.S.C. 154(b) by 202 days.

(21) Appl. No.: 10/968,688

(22) Filed: Oct. 19, 2004

(65) Prior Publication Data

US 2006/0081640 A1 Apr. 20, 2006

(51) Int. Cl.
*B65D 23/12* (2006.01)

(52) U.S. Cl. ..... 220/737; 215/395; 150/901

(58) Field of Classification Search ..... 220/737–739, 220/903; 206/530, 534; 215/12.1, 395; 150/901

See application file for complete search history.

(56) References Cited

U.S. PATENT DOCUMENTS

| | | | | |
|---|---|---|---|---|
| 1,424,667 | A | 8/1922 | Murch | |
| 1,890,323 | A | 12/1932 | Glaeser | |
| 3,680,726 | A | 8/1972 | Massey | |
| 3,918,920 | A | 11/1975 | Barber | |
| 4,282,279 | A | 8/1981 | Strickland | |
| 4,343,158 | A * | 8/1982 | Campbell | 62/372 |
| 4,510,665 | A * | 4/1985 | Scheurer | 29/460 |
| 4,540,611 | A | 9/1985 | Henderson | |
| 4,583,577 | A * | 4/1986 | Canfield | 150/154 |
| 4,746,017 | A | 5/1988 | Howard et al. | |
| 4,886,183 | A * | 12/1989 | Fleming | 220/739 |
| 4,919,296 | A * | 4/1990 | Kirsh et al. | 220/737 |
| 4,948,000 | A | 8/1990 | Grabenkort | |
| 4,955,480 | A * | 9/1990 | Sexton | 206/528 |
| 4,989,811 | A * | 2/1991 | Millis et al. | 248/104 |
| 5,211,307 | A * | 5/1993 | Jeffries | 220/739 |
| 5,332,399 | A | 7/1994 | Grabenkort et al. | |
| 5,415,305 | A * | 5/1995 | Drake-Tipton et al. | 215/392 |
| 5,695,090 | A | 12/1997 | Burdick | |
| 5,730,292 | A * | 3/1998 | Jones | 206/534 |
| 6,059,140 | A * | 5/2000 | Hicks | 220/739 |
| 6,067,803 | A * | 5/2000 | Wolsey et al. | 62/60 |
| D440,828 | S | 4/2001 | Burrus | |
| 6,374,882 | B1 * | 4/2002 | McLoughlin | 150/160 |
| 6,488,170 | B1 * | 12/2002 | Johnson | 220/254.2 |
| 6,508,391 | B2 * | 1/2003 | Gilbert | 224/664 |
| 6,550,271 | B2 | 4/2003 | Silbert | |
| 6,655,543 | B2 | 12/2003 | Beuke | |

(Continued)

FOREIGN PATENT DOCUMENTS

DE 29621235 U1 * 2/1997

OTHER PUBLICATIONS

Bellis, Mary; *Wallace Hume Carothers, The History of Nylon and Neoprene*; website article located at http://inventors.about.com/library/weekly/aa980325.htm; printed Dec. 28, 2004; 4 pages.

(Continued)

*Primary Examiner*—Sue A. Weaver
(74) *Attorney, Agent, or Firm*—Schwartz Cooper Chartered

(57) ABSTRACT

A protective sleeve for an ampoule having an elastic sidewall, a proximal end and a distal end is disclosed. The elastic sidewall has an inner surface and an outer surface. The inner surface defines a chamber adapted for receiving the ampoule. The proximal end has an opening through which the ampoule can be accessed. The distal end is at least partially closed for retaining the ampoule within the chamber.

20 Claims, 2 Drawing Sheets

U.S. PATENT DOCUMENTS

| | | | | |
|---|---|---|---|---|
| 2001/0032867 | A1 | 10/2001 | Silbert | |
| 2003/0146228 | A1* | 8/2003 | Davis et al. | 220/739 |
| 2005/0023173 | A1* | 2/2005 | Paoletti | 206/459.5 |

OTHER PUBLICATIONS

Bryant, Ed; *Tactile Insulin Vials Update*; website article located at http://www.nfb.org/vodold/vow9821.htm; printed Dec. 28, 2004; 1 page.

Flagg, Marianne; *Insulin for type 1 and type 2 diabetes*; website article located at http://www.peacehealth.org; last updated Aug. 27, 2004; printed Dec. 28, 2004; 6 pages; Healthwise, Incorporated; Boise, ID.

Marko, John; *What are polymers and why are they interesting?*; website located at http://www.lassp.cornell.edu/marko/polymers.html; last modified May 23, 1994; printed Dec. 28, 2004; 1 page.

Posey, L. Michael; *Stability of opened insulin vials, syringes varies*; website article located at http://www.pharmacist.com/articles/h_ts_0359.cfm; posted Aug. 27, 2003; printed Dec. 28, 2004; 2 pages.

*Do more injections mean my diabetes is worse?*; website article located at http://www.lillydiabetes.com; Copyright 2004; printed Dec. 28, 2004; 1 page; Eli Lilly and Company; U.S.

*How much insulin do I need?*; website article located at http://www.lillydiabetes.com; Copyright 2004; printed Dec. 28, 2004; 1 page; Eli Lilly and Company; U.S.

*How the body uses insulin*; website article located at http://www.lillydiabetes.com; Copyright 2004; printed Dec. 28, 2004; 2 pages; Eli Lilly and Company; U.S.

*What is insulin and how does it work?*; website article located at http://www.lillydiabetes.com; Copyright 2004; printed Dec. 28, 2004; 1 page; Eli Lilly and Company; U.S.

*What types of insulin are there?*; website article located at http://www.lillydiabetes.com; Copyright 2004; printed Dec. 28, 2004; 3 pages; Eli Lilly and Company; U.S.

*What will I use to take insulin?*; website article located at http://www.lillydiabetes.com; Copyright 2004; printed Dec. 28, 2004; 1 page; Eli Lilly and Company; U.S.

*Which plan is right for me?*; website article located at http://www.lillydiabetes.com; Copyright 2004; printed Dec. 28, 2004; 1 page; Eli Lilly and Company; U.S.

*Will insulin alone control my diabetes?*; website article located at http://www.lillydiabetes.com; Copyright 2004; printed Dec. 28, 2004; 1 page; Eli Lilly and Company; U.S.

* cited by examiner

PROTECTIVE CONTAINER FOR AN AMPOULE

TECHNICAL FIELD

The invention relates to a protective container for an ampoule. More specifically, the invention relates to a multi-layered, elastic protective container for an ampoule having indicia for indicating the type of injectable within the ampoule.

BACKGROUND OF THE INVENTION

An ampoule is a small glass vial sealed after filling chiefly used as a container for a hypodermic injection solution. Ampoules come in many sizes, but generally hold about 0.5 to 50 ml of solution. Ampoules typically include a cylindrical body portion having a closed end. An opposing end includes a necked portion extending radially inwardly. The opposing end is sealed, generally by a thin membrane capable of being penetrated by a needle-type syringe.

Ampoules are produced from glass for several reasons. Glass can be produced to a very translucent clarity. This allows a user to observe the contents of the ampoule, which could be very important depending on the injectable. Glass is also very inert. Though countless efforts have been made to produce a polymer suitable for storing injectables, the medical industry still fears that reactions between the injectable and the polymer could cause deleterious leaching of the polymer into the injectable. Because glass is very stable, such leaching is not a concern.

However, there are drawbacks to glass ampoules. Glass ampoules can break if dropped. At best, this can cause a simple mess and minor hazard due to small shards of glass. At worst, it can cause a bio-medical hazard when the ampoule contains a more volatile or dangerous injectable. Glass is also slick and difficult for some users to handle. And while the clarity of glass is a benefit, it can also be a drawback when the injectable is sensitive to light. The pharmaceutical industry has been conducting research into the use of materials other than glass in the construction of ampoules. They have found some substrates that may work but their cost is significantly higher than that of glass.

Glass ampoules are often used for the storage/transfer of insulin. Insulin allows diabetes sufferers to control their blood sugar (glucose). Insulin cannot be taken by mouth because it would be destroyed by digestion. Instead, most people who need insulin take insulin injections. Therefore, many diabetes sufferers rely on insulin-filled glass ampoules to help treat their disease.

There are more than 20 types of insulin products available in four basic forms, each with a different time of onset and duration of action. The decision as to which insulin to choose is based on an individual's lifestyle, a physician's preference and experience, and the person's blood sugar levels. Some examples of insulin analogs are rapid-acting, short-acting, intermediate-acting, intermediate- and short-acting mixtures, and long-acting.

Blindness often accompanies diabetes. Very early, it was established that blind diabetics could more safely and reliably distinguish between insulin types, thus reducing dangerous dosage errors if codes, other than color coded caps, were included on the ampoules. It was suggested that there be a marking system: one through four horizontal bars on the label of every ampoule of insulin sold in the United States. A single bar would identify rapid acting analogs; two bars would identify regular insulins; three bars would indicate mixed insulin; and four bars would indicate the longer-acting insulins.

The present invention is provided to solve the problems discussed above and to provide advantages and aspects not provided by prior containers of this type. A full discussion of the features and advantages of the present invention is deferred to the following detailed description, which proceeds with reference to the accompanying drawings.

SUMMARY OF THE INVENTION

It is an object of the present invention to provide a sleeve for protecting an ampoule containing an injectable. The sleeve comprises an elastic sidewall, a proximal end, and a distal end. The elastic sidewall has an inner surface and an outer surface. The inner surface defines a chamber adapted for receiving the ampoule. The proximal end has an opening through which the ampoule can be accessed. The distal end is at least partially closed for retaining the ampoule within the chamber.

It is another object of the present invention to provide a protective sleeve for an ampoule. The protective sleeve comprises a continuous sidewall defining an interior chamber for housing the ampoule, an open end through which the ampoule is inserted into the chamber, and an opposing at least partially enclosed end adapted to retain the ampoule within the chamber. The continuous sidewall comprises a first layer produced from a first woven material and a second layer produced from a chloroprene.

It is yet another object of the present invention to provide an elastic sleeve for an ampoule containing an injectable. The elastic sleeve comprises a sidewall, a proximal end, and a distal end. The sidewall has an inner surface and an outer surface. The inner surface defines a chamber adapted for receiving the ampoule containing the injectable. The sidewall comprises a first layer, a second layer, and a third layer. The first layer is produced from a woven material and defines the inner layer. The second layer is produced from a chloroprene and is located between the first and third layers. The third layer is produced from a second woven material and defines the outer surface of the sidewall. The proximal end has an opening through which the ampoule can be accessed. The distal end is at least partially closed for retaining the ampoule within the chamber.

Other features and advantages of the invention will be apparent from the following specification taken in conjunction with the following drawings.

DETAILED DESCRIPTION

Figure 1:
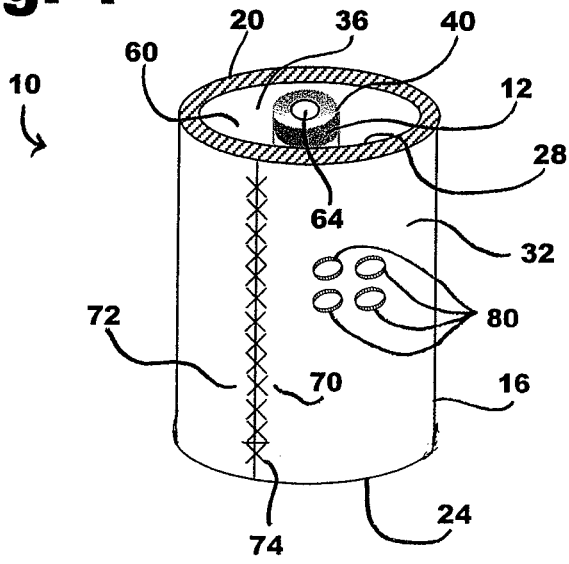
FIG. 1 is a perspective view of a container for protecting an ampoule.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
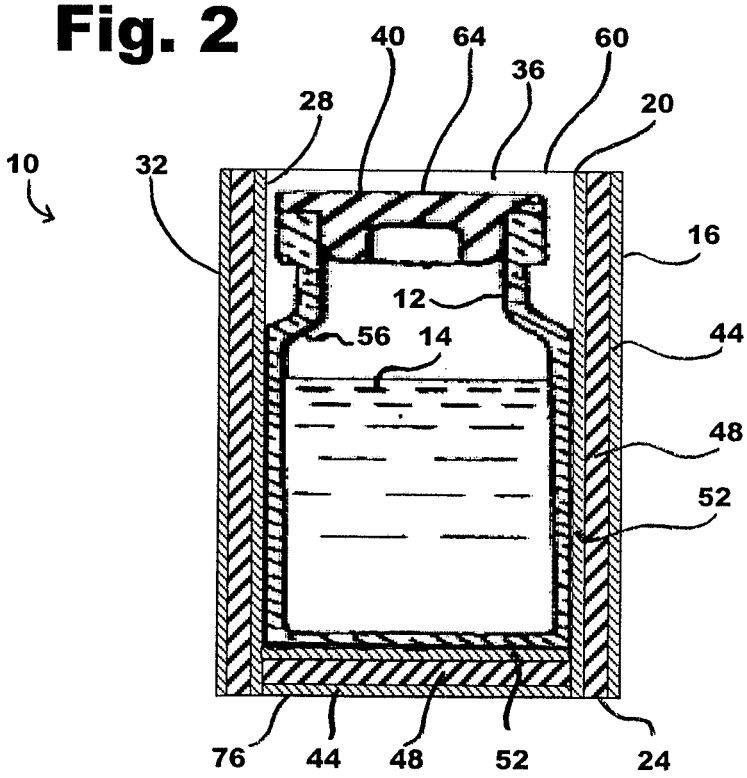
FIG. 2 is a cross-sectional view of the container of FIG. 1.
Figure 3:
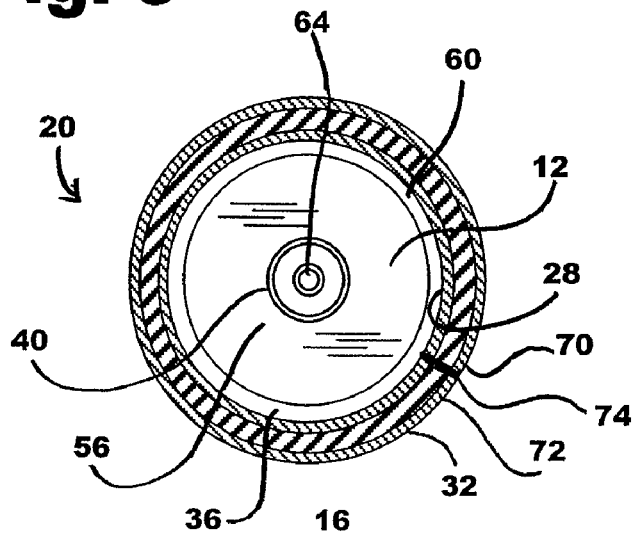
FIG. 3 is a top view of the container of FIG. 1.
Figure 4:
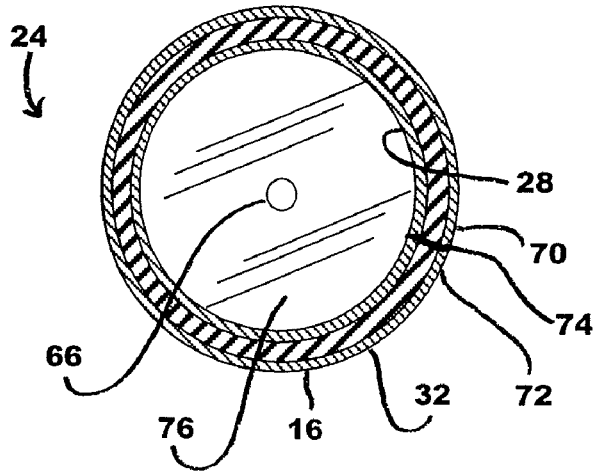
FIG. 4 is a bottom view of the container of FIG. 1.

Referring to FIGS. 1-4, the present invention is directed to a protective container 10 for an ampoule 12 containing an injectable 14, for example, insulin. The protective container 10 is generally a sleeve produced from materials having an elastic quality. The sleeve includes an elastic sidewall 16, a proximal end, 20 and a distal end 24.

The ampoule 12 is a small vial or cartridge, such as the type used to store insulin. The ampoule 12 is generally less than three inches in height and has a cylindrical body portion of less than three and a half inches in circumference. However, the size of the ampoule 12 can vary greatly, but typically fits within the palm of the hand.

The elastic sidewall 16 includes an inner surface 28 and an outer surface 32. The inner surface 28 defines a chamber 36 that is adapted for receiving and housing the ampoule 12. The chamber 36 has a cross-sectional shape that at least approximates the cross-sectional shape of the ampoule 12. It should be noted that the elastic sleeve is intended to be flexible and therefore capable of taking on many different shapes. At the same time, it is preferable for the chamber 36 to have the same cross-sectional area as the ampoule 12 or a slightly smaller cross-sectional area as the ampoule 12. This allows the elastic quality of the sidewall 16 to hold the ampoule 12 firmly in place within the chamber 36. For example, if the ampoule 12 has a circumference of about three inches, the circumference of the inner surface 28 will be about three inches, or slightly less than three inches. This aspect of the invention will be explained in more detail below.

The chamber 36 should be sufficiently deep to allow the ampoule 12 to be stored completely within the chamber 36. However, the chamber 36 can have a shorter length than the ampoule 12 to allow for easier access to the top of the ampoule 12. This allows the ampoule's seal to be broken without having to remove some or all of the ampoule 12 from the chamber 36. It also allows the ampoule's cap 40 to be visible, which is important when the cap 40 is color coded to indicate the type of injectable 14 within the ampoule 12.

The sidewall 16 generally has a multi-layered construction. Accordingly, the sidewall 16 consists of a plurality of layers produced from one or more materials, each material preferably having an elastic quality. A first or outermost layer 44 defines at least a portion of the outer surface 32 of the sidewall 16. A second or intermediate layer 48 is located radially inwardly from the first layer 44. A third or innermost layer 52 is located radially inwardly of the second layer 48 and defines at least a portion of the inner surface 28.

All three layers are preferably produced from elastic materials. The first layer 44 and third layer 52 are preferably produced from a woven material. The material is preferably an elastic fabric such as nylon or the like. The woven material of the innermost layer 48 preferably provides a reduced friction between the ampoule 12 and the sleeve 10, thereby facilitating the entry into and exit from the chamber 12. It has been found that a synthetic woven fabric, such as nylon works well in reducing this friction. Alternatively, these layers can be produced from a smooth surface or roughened surface of the raw material of the second layer 48. Regardless of the material, the first and third layers 44, 52 are generally less than or equal to 15 mils thick, preferably 5 to 15 mils thick, most preferably 10 to 15 mils thick, or any range or combination of ranges therein.

The second layer 48 is produced from a foam, rubber, polymer, synthetic rubber, synthetic or natural fabric, gel, or the like, but preferably a chloroprene, most preferably neoprene. The second layer 48 is generally produced to a thickness of 1.5 to 10 mm, preferably 3 to 6 mm thick, or any range or combination of ranges therein.

Neoprene offers several specific benefits, such as easy insertion and removal of the ampoule 12 from the chamber 36. Because neoprene is elastic, the ampoule 12 may be easily removed from the chamber 36 by allowing fingers to reach in and grab a neck 56 of the ampoule 12 as well as compressing the sidewall 16 adjacent the distal end 24 to push the ampoule 12 through an opening 60 in the proximal end 20. Neoprene is also easy and pleasing to handle. The easily compressible neoprene allows a firmer grip than glass or a more inflexible material. This is especially important because most users would use their dominant hand to hold a syringe and their non-dominant hand to hold the ampoule 12. Neoprene also increases the diameter of the ampoule 12, making it easier to hold without adding a lot of bulk or weight. Neoprene allows moisture to pass through the sidewall 16, and neoprene also has a pleasing look and is available in many colors and patterns.

The proximal end 20 includes the opening 60 for accessing the ampoule 12. The opening 60 is preferably large enough so that the ampoule 12 can be forced through the opening 60 and into the chamber 36. The proximal end 20 may be tapered radially inwardly for further insurance against the ampoule 12 accidentally slipping out of the chamber 36, but is preferably as wide as the chamber 36 to allow weaker users to more easily insert and withdraw the ampoule 12 from the chamber 36. In either case, the opening 60 should at least be adapted to allow the user to insert a syringe through a thin membrane 64 and into the ampoule 12 to withdraw the injectable 14 from the ampoule 12 with little or no difficulty.

The distal end 24 is at least partially closed for retaining the ampoule 12 within the chamber 36. A small port 66 may be included in the distal end 24 to eliminate a vacuum pressure that could be created upon withdrawing the ampoule 12 from the chamber 36. This arrangement would further increase the ease with which a physically weak user could withdraw the ampoule 12 from the chamber 36.

The protective container or sleeve 10 can be constructed in any number of ways. Preferably, the sidewall 16 is formed from a rectangular-shaped length of chloroprene sheet that is formed into a cylinder having a continuous sidewall 16 defining an interior chamber 36. Opposing ends 70, 72 of the rectangle are joined to each other at a seam 74 to form the cylinder. The ends 70, 72 may be sewn, welded, and/or glued together to form the seam 74. It should be understood that any means of fixing the two ends together would be suitable as long as the bond is reliable and would not break upon forcing the ampoule's 12 entry into or exit from the chamber 36.

The distal end 24 may be formed by attaching a separate member 76, preferably a disk-shaped member, to one of the open ends of the cylinder to at least partially enclose the cylinder. The separate member 76 is preferably produced from the same material used to produce the sidewall 16. The separate member 76 could be attached in any manner, but preferably similar to the fixing of the opposing ends 70, 72 of the rectangular-shaped chloroprene sheet.

Alternatively, the distal end 24 could be formed by simply pinching opposing sides of the cylinder (i.e., separated by approximately 180 degrees) together. A seam can then be created by sewing, gluing, or any other suitable method. This forms a pocket structure.

The protective container 10 may also include an indicia 80 of the type of injectable 14 within the ampoule 12. The indicia 80 could take one or more forms, but preferably includes a form capable of being sensed by the sense of touch or feel (i.e. tactile) whereby a blind user could identify the contents. Accordingly, a window or series of windows could be placed on the container, preferably on the sidewall 16. The windows could allow the user to either see the label on the ampoule 12, or the number of windows could act as the indicator of the type of injectable within the ampoule 12.

Several other indicia 80 could be provided. For instance, the protective container 10 could be color coded. The outer surface 32 could be produced according to a color scheme to identify the contents of the ampoule 12. Other methods provided could include embossing, debossing, or Braille-type communication means.

The present invention provides many advantages. The container 10 provides protection against breakage, if dropped, without adding significant size or weight to the ampoule 12. A label showing the date the ampoule 12 was first opened can be affixed to the container 12. In the case of insulin-filled ampoules 12, the container 10 can be punched with holes (windows) for sight-impaired individuals, so they can determine the difference between fast, regular and slower acting insulins. Additionally, the ampoule 12 can be refrigerated without removing it from the sleeve 10 and a syringe can be filled without removing the ampoule 12 from the container 10. The container 10 of the present invention can be reused and used continuously from the time of opening the ampoule 12 to the time that ampoule 12 is discarded and a new ampoule 12 is inserted. The container 10 is easy to handle and fits comfortably in the palm of the user's hand.

The present invention also overcomes some of the drawbacks associated with other similar containers. For example, the present container 10 is not for transport only, and the thin membrane of the ampoule 12 can be easily accessed by a syringe.

Several alternative embodiments have been described. A person of ordinary skill in the art would appreciate that the features of the individual embodiments, for example, variations of the proximal end or construction, can be applied in combination with any of the material variations to arrive at a suitable ampoule container 10. Further, the terms "first," "second," "upper," "lower," etc. are used for illustrative purposes only and are not intended to limit the embodiments in any way, and the term "plurality" as used herein is intended to indicate any number greater than one, either disjunctively or conjunctively as necessary, up to an infinite number. The term "joined" is used to mean connected to, as with as many intervening elements as necessary or desired. For example, the opposing ends 70, 72 of the rectangular-shaped length of chloroprene may be joined through a layer of adhesive, cement, fabric, etc. Still further, this invention has been developed for use not only with insulin but with any injectable 14, including but not limited to fertility and hemophilia drugs.

While the specific embodiments have been illustrated and described, numerous modifications come to mind without significantly departing from the spirit of the invention, and the scope of protection is only limited by the scope of the accompanying claims.

What is claimed is:

1. A sleeve for protecting an ampoule containing an injectable, the sleeve comprising:

an elastic sidewall having an inner surface and an outer surface, the inner surface defining a chamber adapted for receiving the ampoule and comprising a friction reducing material wherein entry and exit of the ampoule into and out of the chamber is facilitated;

a proximal end having an opening through which the ampoule can be accessed; and, a distal end being at least partially closed for retaining the ampoule within the chamber.

2. The elastic sleeve of claim 1 wherein the sidewall comprises a first layer.

3. The elastic sleeve of claim 2 wherein the sidewall comprises a second layer.

4. The elastic sleeve of claim 3 wherein the sidewall comprises a third layer.

5. The elastic sleeve of claim 4 wherein at least one of the first, second or third layers is produced from a chloroprene.

6. The elastic sleeve of claim 5 wherein the first layer defines the inner wall of the sidewall, and the third layer defines the outer wall of the sidewall, the second layer being located between the first and third layers.

7. The elastic sleeve of claim 6 wherein the first layer is produced from a first woven material.

8. The elastic sleeve of claim 7 wherein the third layer is produced from a second woven material.

9. The elastic sleeve of claim 8 wherein the first woven material is an elastic material.

10. The elastic sleeve of claim 9 wherein the second woven material is an elastic material.

11. The elastic sleeve of claim 10 wherein the first and third layers are less than or equal to 15 mils thick.

12. The elastic sleeve of claim 11 wherein the second layer is 1.5 to 10 mm thick.

13. The elastic sleeve of claim 12 further comprising an indicia indicating a type of injectable within the ampoule.

14. The elastic sleeve of claim 13 wherein the indicia is tactile.

15. The elastic sleeve of claim 14 wherein the indicia is a window on the sidewall.

16. The elastic sleeve of claim 15 wherein the sidewall and the distal end are separate components fixedly attached to one another.

17. A protective sleeve for an ampoule, the protective sleeve comprising:

a continuous sidewall defining an interior chamber for housing the ampoule, an open end through which the ampoule is inserted into the chamber, and an opposing at least partially enclosed end adapted to retain the ampoule within the chamber, the continuous sidewall comprising a first layer defining a wall of the chamber and produced from a friction reducing material and a second layer produced from a chloroprene.

18. The protective sleeve of claim 17 wherein the continuous sidewall further comprises a third layer produced from a woven material, wherein the second layer is located between the first and third layers.

19. The protective sleeve of claim 17 wherein the continuous sidewall includes an indicia of a type of injectable contained within the ampoule.

20. An elastic sleeve for an ampoule containing an injectable, the elastic sleeve comprising:

a sidewall having an inner surface and an outer surface, the inner surface defining a chamber adapted for receiving the ampoule containing the injectable, the sidewall comprising a first layer, a second layer, and a third layer, the first layer being produced from a woven material and defining the inner layer, the second layer being produced from a chloroprene and located between the first and third layers, the third layer being produced from a second woven material and defining the outer surface;

a proximal end having an opening through which the ampoule can be accessed; and, a distal end being at least partially closed for retaining the ampoule within the chamber.

* * * * *